US007909192B2

(12) United States Patent
Dempsey et al.

(10) Patent No.: US 7,909,192 B2
(45) Date of Patent: Mar. 22, 2011

(54) MOISTURE ABSORBENT SCAVENGER AND VACUUM RELIEF DEVICE FOR CHEMICAL CONTAINERS

(75) Inventors: Robert J. Dempsey, Trumbull, CT (US); Roland P. Weil, Woodbury, CT (US); Geeta Govindan, Naugatuck, CT (US); Reine Smirz, Gastonia, NC (US)

(73) Assignee: Chemtura Corporation, Middlebury, CT (US)

( * ) Notice: Subject to any disclaimer, the term of this patent is extended or adjusted under 35 U.S.C. 154(b) by 277 days.

(21) Appl. No.: 11/433,601

(22) Filed: May 12, 2006

(65) Prior Publication Data

US 2006/0255001 A1 Nov. 16, 2006

Related U.S. Application Data

(60) Provisional application No. 60/680,512, filed on May 13, 2005.

(51) Int. Cl.
*B65D 51/16* (2006.01)

(52) U.S. Cl. ..... 220/203.03; 220/203.17; 220/203.18; 220/373

(58) Field of Classification Search ..... 220/203.03, 220/203.1, 203.17, 203.18, 203.28, 374, 220/373, 203.01, 203.29, 231, 203.26; 215/11.5, 215/262

See application file for complete search history.

(56) References Cited

U.S. PATENT DOCUMENTS 1,095,014 A 4/1914 Mauck et al.
1,808,702 A * 6/1931 Williams ..... 215/260
2,173,571 A * 9/1939 Jesnig ..... 137/854
2,686,610 A 8/1954 Sharpnack, Sr.
2,774,523 A 12/1956 Rieke
3,072,284 A * 1/1963 Luhman, Jr. ..... 220/374
3,696,958 A * 10/1972 Lee ..... 215/261
3,943,987 A 3/1976 Rossi
3,951,293 A * 4/1976 Schulz ..... 215/261
4,004,709 A 1/1977 Simkus
4,040,404 A 8/1977 Tagawa
4,091,837 A 5/1978 Edmunds et al.
4,157,072 A 6/1979 West
4,323,096 A 4/1982 Dugge et al.
4,465,189 A 8/1984 Molzan
4,765,499 A * 8/1988 von Reis et al. ..... 215/261
5,226,558 A * 7/1993 Whitney et al. ..... 220/571
5,348,179 A * 9/1994 Walker ..... 220/203.18
5,397,024 A 3/1995 Wu et al.
5,515,994 A * 5/1996 Goglio ..... 220/372
5,709,313 A 1/1998 Richoux et al.
5,727,707 A * 3/1998 Wickland et al. ..... 220/288
5,730,306 A * 3/1998 Costa et al. ..... 215/261
5,730,785 A * 3/1998 Idol et al. ..... 96/108
5,735,317 A * 4/1998 Wu ..... 141/65

(Continued)

*Primary Examiner* — Anthony Stashick
*Assistant Examiner* — Christopher B McKinley
(74) *Attorney, Agent, or Firm* — Joann Villamizar

(57) ABSTRACT

The invention is a vent for use with a container, such as commercial steel pails and drums, and a method for venting containers. The vent has a cap seal with one or more semi-permeable membranes covering an orifice in the cap seal. The membrane prevents the passage of at least one atmospheric component, but allows the free passage of air. When a product is filled into the container at an elevated temperature and cools, a vacuum is formed within the container. The resulting vacuum opens a vacuum release device in the vent and pulls air through a hole in the cap seal, which is protected by a micro-porous membrane. The venting of air into the container relieves the vacuum without damage to the container or the product within the container.

9 Claims, 1 Drawing Sheet

U.S. PATENT DOCUMENTS 5,759,241 A * 6/1998 Klett et al. ..... 96/134
5,782,266 A * 7/1998 Domke ..... 137/551
5,836,351 A * 11/1998 Underwood, III ..... 137/587
5,891,223 A * 4/1999 Shaw et al. ..... 96/134
5,944,212 A 8/1999 Chang
5,954,214 A * 9/1999 Guezennec et al. ..... 215/262
5,988,426 A * 11/1999 Stern ..... 220/371
6,089,271 A * 7/2000 Tani ..... 137/854
6,206,220 B1 * 3/2001 Stodd ..... 220/231
6,468,332 B2 * 10/2002 Goglio et al. ..... 96/134
6,470,860 B1 * 10/2002 McClure et al. ..... 123/516
6,619,493 B2 9/2003 Yang
6,726,047 B2 * 4/2004 Lin ..... 220/203.11
6,776,301 B2 * 8/2004 Torres-White et al. .. 220/203.17
6,789,690 B2 9/2004 Nieh et al.
6,883,675 B2 * 4/2005 Maenke ..... 220/203.11
7,201,287 B2 * 4/2007 Maenke ..... 220/203.11
7,325,381 B2 * 2/2008 Waldron ..... 53/432
2003/0146216 A1 * 8/2003 Torres-White et al. .. 220/203.17
2004/0140308 A1 * 7/2004 Maenke ..... 220/203.13
2005/0098559 A1 * 5/2005 Morales et al. ..... 220/62.17

* cited by examiner

MOISTURE ABSORBENT SCAVENGER AND VACUUM RELIEF DEVICE FOR CHEMICAL CONTAINERS

We claim the benefit under Title 35, United States Code, §120 of U.S. Provisional Application No. 60/680,512, filed May 13, 2005, entitled MOISTURE ABSORBENT SCAVENGER AND VACUUM RELIEF DEVICE FOR CHEMICAL CONTAINERS.

BACKGROUND OF THE INVENTION

1. Field of the Invention

The invention relates to containers for chemicals and other moisture-sensitive materials. More particularly, the invention relates to containers having vacuum-breaking relief closures incorporating a moisture scavenger.

2. Description of Related Art

The chemical industry utilizes various containers for chemical products. One of the most common types of drums is a thin wall steel drum that is typically manufactured in a fifty-five (55) gallon capacity. Such drums include a cylindrical side wall and a pair of circular ends. One of the ends provides a pair of openings or bungs, one of which is a larger opening for dispensing and filling the drum container. The other is a smaller opening for venting the container. Drum openings can be, for example, in the two to three inches (2"-3") diameter size range for the fill/dispensing opening and one and one half inches (1.5") for the vent opening.

U.S. Pat. No. 2,686,610 to Sharpnack, Sr., discloses a metal drum. This drum is typically standardized to capacities of, for example, 15-gallon, 30-gallon, and 55-gallon. Such drums are commonly used to carry an abundance of liquid products, including oil, petrochemicals, chemicals, solvents, water, and the like.

Numerous patents disclose containers and drums with opening means and/or spouts. Pail lids with spouts have been used for years to provide consumers with the option of dispensing the contents of the pail through the spout.

U.S. Pat. No. 2,774,523 to Rieke discloses a metal liquid container with a pull-out spout disposed in a neck of an opening defined in the lid. The patented spout is not connected to the neck or lid. When forcibly pulled upwards the spout is slidably displaced through the neck of the opening in the lid. In a closed position, the top shoulders disposed proximate the top of the spout engage with a retaining ring disposed about a sealing plug to seal the contents within the pail. To dispense the contents of the container through the spout, the spout is pulled up through the neck by a pull tab with a sufficient amount of force so that the top shoulders of the spout pass beyond the retaining ring. The spout continues to be displaced upward until lower shoulders disposed proximate the bottom of the spout engage with the retaining ring to form a seal to prevent leakage while the contents of the pail is dispensed through the spout. The seal formed between the shoulders of the spout and retaining ring is not air tight. Accordingly, this spout is not suitable for storing a product that is not be exposed to air.

U.S. Pat. No. 4,004,709 to Simkus discloses a drum closure. The drum closure uses an extra fitting mated to the drum stock can be seen in. A threaded closure construction is disclosed for light-gauge steel drums. The closure provides an internally threaded closure flange mechanically secured within a suitably formed container wall opening. The flange is formed with a cylindrical neck internally threaded throughout its lower extent and surrounded exteriorly by a polygonally shaped base. A resilient sealing gasket tightly surrounds the flange neck at its juncture with the flange base. A perforated drum stock section is formed to overlie and closely surround the flange neck and base in a torque-resisting manner with the upper end of the flange neck beaded outwardly over the surrounding drum stock. The closure is completed with the threaded engagement of a closure plug and application of an overlying tamper-resisting drum seal.

U.S. Pat. No. 4,091,837 to Edmunds et al. discloses a freezeproof breather valve. The invention of this patent is a valve for controlling the pressure within a tank to prevent excessive pressures above or below atmospheric pressure conditions. The invention includes a pressure responsive valve and a vacuum responsive valve, wherein each valve includes a pallet with seals and blowdown rings of polytetrafluoroethylene (Teflon®). The pressure pallet includes guide means having Teflon parts, while the vacuum responsive valve includes hinge means having coated Teflon® parts. The breather valve includes a structure which defines a vertically extending vent structure having an opening arranged alongside the tank in which the valve is mounted. The opening is positioned to avoid being sealed by a normal buildup of ice and snow.

U.S. Pat. No. 4,323,096 to Dugge et al. discloses a vacuum relief valve assembly that includes a vacuum valve member located below a top cover plate and is thus protected from the atmosphere. First passageways defined in part by a bottom cover plate provide communication between the outside atmosphere and the lower surface of the valve. Second passageways provide communication between the upper surface of the valve and the inside of the container. When the pressure in the container is below atmospheric, atmospheric pressure acting on the bottom of the valve lifts the valve and air flows through the first and second passageways until atmospheric pressure is reached in the tank. A pressure relief valve is mounted for pivotal movement relative to an opening providing communication between the pressure in the tank and the first passageways to vent pressure in the tank. The pressure relief valve is protected from the atmosphere by the top cover plate and in one embodiment by the vacuum relief valve.

U.S. Pat. No. 4,465,189 to Molzan discloses a self-venting waterproof container that includes upper and lower waterproof body portions along with a sealing mechanism to effect a seal therebetween. A pressure relief valve provides venting communication between the interior of the container and the environment in which the container is used when there is a differential in environmental pressure and the pressure in the interior of the container. A vacuum relief valve eliminates, when opened, any vacuum existing in the interior of the container. Deformable material used for the body portions allows the container to collapse around the equipment therein under environmental pressure.

U.S. Pat. No. 5,348,179 to Walker discloses a capping assembly for attachment to a ferrule of a manhole assembly in a tanker truck having a cap that is provided with a central aperture for venting. The cap is further provided with threads for accommodating the threads of the ferrule. A diaphragm having a flexible central member larger than the aperture of the cap and peripheral apertures is fittably connectable to the ferrule and positionable between the cap and the opening of the ferrule. The diaphragm includes an outer circumferential beveled surface for seatingly engaging a beveled upper inner surface of the ferrule.

U.S. Pat. No. 5,397,024 to Wu et al. discloses a container that includes a top-open container body. The top-open container body has a tapered top-flange around the top opening thereof, and a top cover having a tapered bottom flange fitted around the top flange of the container body. The top cover has a stepped air hole and a push-button plug assembly mounted within the stepped air hole and that can be pressed to control the passage; the top cover has a recessed retaining portion that can be moved to engage with a raised retaining portion on the container body for letting air pass through air guide grooves on the top cover and container body into the inside space of the container body.

U.S. Pat. No. 5,709,313 to Richoux et al. discloses a drum outlet and closure apparatus for use with cylindrical steel drums having an outlet fitting with a peripheral shoulder that is generally S-shaped to accept a cap seal, such as a commercially available metallic cap seal. The shoulder protects an inwardly spaced threaded section. In another embodiment, the drum outlet is formed of parent metal of the drum end, formed into an annular shoulder and then partially threaded. An upper unthreaded section is folded to define a closure sealing surface. The threaded section accepts a threaded closure fitting. An unthreaded lower interior section provides enhanced strength and protects the threading.

U.S. Pat. No. 5,944,212 to Chang discloses a container that includes a container body, a cap member, a disk member, and an evacuating unit. The cap member is mounted on a top open end of the container body and is rotatable about a vertical axis. The disk member is provided beneath and inside the cap member to sealingly close the top open end. The disk member has a downward hollow mounting portion in fluid communication with the top open end. The evacuating unit is operable by the cap member for evacuating air from the container body, and is coupled with the disk member. The evacuating unit has a piston mounted on the downward hollow mounting portion. The piston is movable upward and downward in the downward hollow mounting portion via rotation of the cap member so as to draw air from the container body.

U.S. Pat. No. 6,470,860 to McClure et al. discloses a venting system for a tank in the form of a vapor bypass tube that is interfaced with a melt plug. The bypass tube provides a vapor pressure bypass of the melt plug hole. The vapor bypass tube has a first end mounted to the tank body circumscribably in relation to the melt plug. The vapor bypass tube has a second end, opposite the first end, that is open and located deep inside the tank. A vent aperture is provided in the vapor bypass tube adjacent the first end, which provides vapor displacement from within the vapor bypass tube when the tank is being refueled.

U.S. Pat. No. 6,619,493 to Yang discloses a sealable container that has a container body and a cover closed on the container body and is provided with a push button and a suction hole. The cover is combined with a release assembly and an outer cap therein. The release assembly includes a housing, a membrane piece, a covering piece, and a follower. A combination of these components enables the sealable container to be effectively proofed against moisture and mildew after the air in the container body is removed. When the cover is to be opened for removing food stored in the container body, it is only necessary to press the push button of the cover to release the vacuum in the container body, making it convenient to open the cover.

U.S. Pat. No. 6,726,047 to Lin discloses a resilient vacuum relief valve that is urged tightly on a lid stem engaging the lid bottom while encircling a vent preventing air passage through the vent. The vacuum relief valve is formed of a pliable, resilient thermoplastic such as silicon and is in an inverted hat shape or dish shape and includes a circumferential outwardly extending rim on top that has sufficient resilience to deform when exposed to negative pressure. This arrangement provides an air tight seal when the lid is inserted into the canister body and while it remains stationary. However, when the lid is pulled upwardly, negative pressure within the canister is created. This pressure forces the valve to break its seal and relieve the newly created vacuum within the canister allowing it to be easier to dislodge the lid and prevents dispersal of powdered contents out of the canister during lid removal.

U.S. Pat. No. 6,789,690 to Nieh et al. discloses a hose direct cannister lid that includes a port that accepts a hose connected to a source of vacuum in order to evacuate a cannister to which the lid is connected. The hose direct cannister lid includes a first valve for exposing the cannister to the source of vacuum when the vacuum hose is secured to the lid. The first valve closes when the source of vacuum is removed in order to seal the lid and cannister from ambient conditions. The hose direct cannister includes a second valve used to break the vacuum and expose the interior of the cannister to ambient conditions.

It is common practice in the chemical industry to fill containers with a product that is still hot from the process employed in its manufacture. Once the containers are filled, they can be immediately capped to prevent air from coming into contact with the products, which could result in undesirable side reactions. As the product subsequently cools, a vacuum can be formed that can cause denting and the partial collapse of the container. Although vacuum relieving devices are known in the art and are commercially available, they cannot be used in some applications because the air entering the container may contain moisture, which can be reactive with certain products, such as urethanes.

The present invention provides a solution to an industry problem of releasing the vacuum created during the hot-filling of a product into containers while protecting the product from the passage of moisture, oxygen, nitrogen, and other atmospheric components either into or out of the container.

SUMMARY OF THE INVENTION

The invention includes a venting means. The venting means is used with a container, such as a commercial steel pail or a drum. The venting means includes an impervious cap seal, which has opposite top and bottom sides. The venting means includes at least one membrane that is semipermeable and prohibits passage of at least one atmospheric component. The cap seal in combination with the membrane permits pressure equalization within the container while protecting a stored product.

Preferred embodiments of the invention include a venting means for use with a container, wherein the venting means includes a cap seal having opposite top and bottom sides and at least one membrane. At least one of the membranes is semipermeable to prevent passage of at least one atmospheric component while allowing the passage of air. The cap seal in combination with the membrane permits equalization within the container while protecting the product.

The invention also includes a method for venting a container. The steps of the method include forming an impervious cap seal which has opposite top and bottom sides. Then the step of inserting into the cap seal at least one membrane that is semipermeable and prohibits passage of at least one atmospheric component occurs. The step of equalizing pressure within the container through the cap seal in combination with the membrane then occurs.

DESCRIPTION OF THE PREFERRED EMBODIMENT(S)

Figure 1:
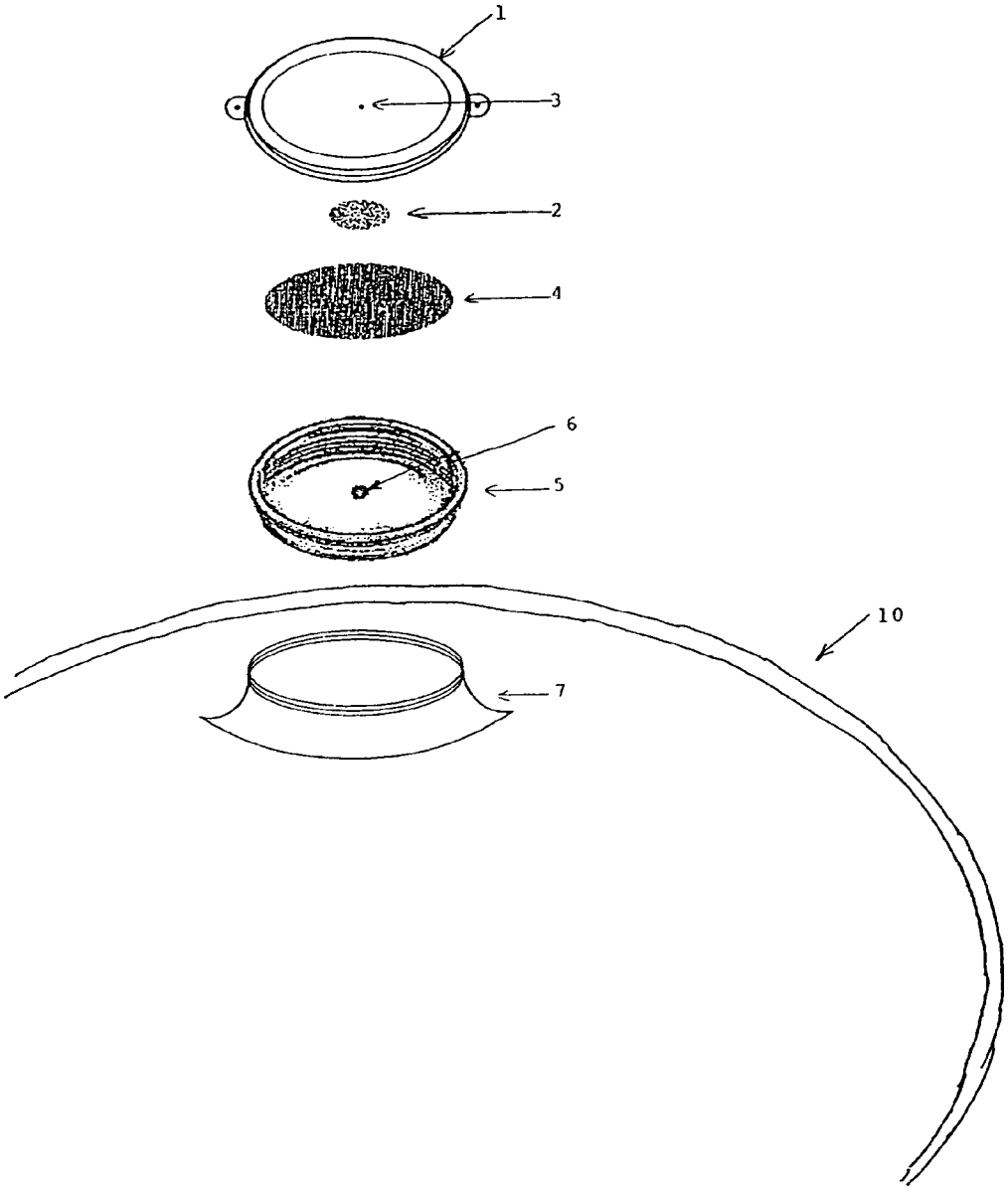
FIG. 1 illustrates a detailed view of the preferred embodiment of the venting means of this invention.

The invention is a venting means and a method for venting a vacuum in a container or drum created during the cooling of a product that was hot-filled into the container while preventing the passage of at least one atmospheric component into the container. The venting means is desirably used with a container such as a commercial steel pail or drum. Specifically, the venting means prevents the vacuum collapse of the container while protecting the product in the container from one or more atmospheric components. The venting means desirably combines a cap seal having opposite sides with at least one semipermeable membrane that prevents the passage of one or more atmospheric components while permitting equalization of the pressure within the container. The prohibition of the passage of one or more atmospheric components is selected to protect the product stored in the container.

Alternatively, the invention can also have a scavenger to assist in preventing the passage of an atmospheric component. The invention can include a venting closure to work in conjunction with the cap seal to contain the membranes and scavengers used.

There are two common types of metal closures for steel drums or pails. These closures are known as a Trisure design and a Rieke design. The device of the present invention is intended for use with either of these closure systems as well as with other closures known in the art.

The cap seal provides both the structure and venting function to the venting means. The cap seal has two opposing sides with at least one orifice leading from one side to the other and can be constructed in any substantially planar geometric shape to fit the opening of the container. The cap seal can be removable from the container or attached thereto and can be constructed of metal or other impervious material.

The membrane of the venting means prevents the passage of atmospheric components through the orifice of the cap seal. The membrane also prevents passage of product from the container. There can be multiple membranes used in combination with the cap seal. At least one semipermeable membrane is used in connection with the cap seal. The semipermeable membrane can be positioned on either side of the cap seal. The semipermeable membrane can be impervious to water and/or other compounds.

Suitable semipermeable membranes can be selected from commercially available membranes. The selection of a semipermeable membrane can be made based upon one or more elements or compounds that the membrane permits to pass or prohibits from passing.

One or more membranes of the venting means can also contain a scavenger. The addition of a scavenging means to the venting means assists in the prevention of materials passing into or out of the container. The scavenging means prevents entry, for example, of oxygen, water, carbon dioxide, ozone, and the like as well as mixtures thereof into the container. The scavenger means can also prevent the exit of the product such as polyurethane from the container. The scavenging means preferably includes a form fitting pouch of a sorbent material, for example, silica gel, activated carbon, a molecular sieve, and mixtures thereof. The scavenger means can also be selected from commercially available materials and can be selected based upon one or more elements or compounds that it scavenges.

In an alternative embodiment of the present invention, the venting means includes a cap seal, at least one membrane, and plugging means. The plugging means provides the structure and venting function to the venting means. The plugging means is preferably a vented closure with two opposing sides and at least one orifice. The vented closure can be removable from the container or attached thereto and removably connects the venting means to the container or drum. The vented closure can be constructed in any structure suitable to provide a seal to be formed with the container such as by snapping, clamping, welding, or screwing onto the opening of the container. The vented closure can be constructed in any suitable geometric shape to fit the opening of the container and can be constructed of metal or other impervious material.

The vented closure of the venting means is desirably constructed of cut metal or other materials known to those skilled in the art. The membrane can be selected from those commercially available or can be developed by those of ordinary skill in the art and cut to fit the particular needs. The scavenging means can also be selected from those commercially available or developed to satisfy a particular need and constructed to be form-fitting to the venting means. The vented plug is constructed of cut metal or other means known to one skilled in the art. The venting means can be assembled and attached to the container or drum in a manner to ensure sealing for proper vacuum release.

FIG. 1 illustrates a cap seal 1 of a container 10 having a flange 7 The container 10 can be, for example, a steel drum or pail. The cap seal is provided with a micro-porous membrane 2 either over or under a first orifice 3 in the cap seal 1. The membrane 2, which is desirably made of polytetrafluoroethylene, is designed to be impervious to water, yet allow for the free passage of air or of atmospheric nitrogen. When the cap seal 1 is open, air flows in and through a form-fitted protective scavenging insert 4 which is positioned between the cap seal 1 of the container 10 and a vented closure 5 having a second orifice 6. The protective scavenging insert 4 includes a sorbent material in the form of a formed pouch, which is desirably fit to either a two inch or ¾ inch internal opening of the cap seal 1. The sorbent material can be selected to meet the specific needs of the user and can include, for example, silica gel, clay, activated carbon, molecular sieve materials, or the like to sorb moisture from the ambient air.

When the container 10 is filled with a product at an elevated temperature, a vacuum is formed as the heated product cools. The resulting vacuum opens the venting means, pulling air through the first orifice 3 in the cap seal 1, which is protected by the micro-porous membrane 2. Then through the protective scavenging insert 4 containing the sorbent material, the vacuum is relieved without damage to the container 10. Once the pressure on both sides of the vacuum release device is equalized, the vented plug 5 closes, thereby preventing additional air from entering the container 10.

The venting means can be constructed in alternative geometric shapes to adapt to the requirements of the container. The venting means can be constructed, for example, in a rectangular, square, or oval shape.

An alternative embodiment of the cap seal can have at least one first orifice in combination with at least one membrane. The membrane can, for example, be located on top of the first orifice of the cap seal.

Another alternative of the cap seal can have at least one first orifice in combination with at least one membrane. The membrane can be located, for example, below the first orifice of the cap seal.

The device of the present invention is especially useful in containers, such as steel drums, steel pails, or plastic drums, that utilize a Trisure or Rieke metal or nylon flange closure system.

In view of the many changes and modifications that can be made without departing from principles underlying the invention, reference should be made to the appended claims for an understanding of the scope of the protection to be afforded the invention.

What is claimed is:

1. A venting system for use with a container comprising:

a cap seal that allows air flow in when a vacuum is formed inside the container, the cap seal defining an orifice therethrough;

at least one membrane means disposed between the orifice of the cap seal and a vented closure, the membrane being semipermeable for prohibiting passage of at least one atmospheric component through the cap seal while allowing the passage of air into the container and for prohibiting passage of a product out of the container;

a scavenger means comprising a sorbent material selected from the group consisting of silica gel, activated carbon, a molecular sieve, and mixtures thereof, for prohibiting passage of materials in ambient air into the container and for prohibiting passage of the product out of the container;

wherein said vented closure does not allow an air flow into the container when the pressure is equalized within the container such that the cap seal, the membrane means, the scavenger means, and the vented closure function as a vacuum relief valve without moving parts.

2. A venting system of claim 1 wherein the atmospheric component is selected from the group consisting of oxygen, water, carbon dioxide, ozone, and mixtures thereof.

3. A venting system of claim 1 wherein the atmospheric component is water.

4. A venting system of claim 1 wherein the membrane means is semipermeable to the product in the container.

5. A venting system of claim 1 wherein the at least one semipermeable membrane means is positioned on a top side of the cap seal.

6. A venting system of claim 1 wherein the at least one semipermeable membrane means is positioned on a bottom side of the cap seal.

7. A venting system of claim 1 wherein the scavenger means is a form-fitting pouch that fits and seals the vented closure.

8. A method for venting a container filled with a heated product by means of a venting system including a semipermeable membrane and a scavenger sandwiched between a cap seal having an orifice and a vented closure having an orifice, comprising:

allowing a flow of air into the container through the orifice of the cap seal and the orifice of the vented closure when a vacuum is created inside the container;

prohibiting passage of at least one atmospheric component through the cap seal while allowing the passage of air into the container and prohibiting passage of a product out of the container with said membrane, that is semipermeable such that the membrane functions as a valve element and;

prohibiting passage of a material in ambient air into the container and the product out of the container with the scavenger which comprises a sorbent material selected from the group consisting of silica gel, activated carbon, a molecular sieve, and mixtures thereof;

wherein ambient air ceases to flow through said orifices when the pressure is equalized within the container such that the combination of the cap seal, the membrane, the scavenger, and vented closure function as a vacuum relief valve without moving parts.

9. A container filled with a product having a venting system, the venting system comprising:

a cap seal that allows a flow of ambient air into the container when a vacuum is formed inside the container, the cap seal defining an orifice therethrough;

at least one membrane disposed between the orifice of the cap seal and a vented closure, the membrane being semipermeable such that the membrane prohibits passage of at least one atmospheric component through the cap seal while allowing the passage of air into the container;

a scavenger comprising a sorbent material selected from the group consisting of silica gel, activated carbon, a molecular sieve, and mixtures thereof that prohibits passage of materials into the container in ambient air and prohibits passage of the product out of the container;

wherein said a vented closure does not allow an air flow into the container when the pressure is equalized within the container such that the cap seal, the membrane, the scavenger, and the vented closure form a vacuum relief valve without moving parts.

* * * * *